US006778790B2

(12) United States Patent
Yoshinaga et al.

(10) Patent No.: US 6,778,790 B2
(45) Date of Patent: Aug. 17, 2004

(54) FIXING DEVICE CAPABLE OF PREVENTING EXCESSIVE INCREASE IN TEMPERATURE

(75) Inventors: Hiroshi Yoshinaga, Chiba (JP); Motokazu Yasui, Kanagawa (JP); Masanao Ehara, Saitama (JP); Hideo Furukawa, Kanagawa (JP); Yukiko Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/176,587

(22) Filed: Jun. 24, 2002

(65) Prior Publication Data

US 2003/0016963 A1 Jan. 23, 2003

(30) Foreign Application Priority Data

Jun. 22, 2001 (JP) ..... 2001-190225
May 1, 2002 (JP) ..... 2002-129882

(51) Int. Cl.[7] ..... G03G 15/20
(52) U.S. Cl. ..... 399/69; 399/67
(58) Field of Search ..... 399/67, 68, 69, 399/70, 82, 328, 329; 219/216; 347/156

(56) References Cited

U.S. PATENT DOCUMENTS 5,303,015 A * 4/1994 Sato ..... 399/69
5,315,350 A * 5/1994 Hirobe et al. ..... 399/69
6,006,050 A 12/1999 Watanabe
6,014,532 A 1/2000 Takeichi et al.
6,055,388 A 4/2000 Watanabe et al.
6,055,394 A 4/2000 Suda et al.
6,101,351 A 8/2000 Suda et al.
6,118,964 A 9/2000 Kojima et al.
6,134,400 A * 10/2000 Higashi et al. ..... 399/70
6,181,890 B1 * 1/2001 Kataoka et al. ..... 399/67
6,208,826 B1 3/2001 Yoshinaga et al.
6,219,520 B1 4/2001 Ehara
6,256,465 B1 7/2001 Yoshinaga et al.
6,333,490 B1 * 12/2001 Higashi et al. ..... 219/216
6,334,039 B1 12/2001 Yoshinaga et al.
6,336,013 B1 1/2002 Suda et al.
6,366,754 B1 4/2002 Sato et al.

FOREIGN PATENT DOCUMENTS

JP 10-039678 2/1998
JP 10-254269 9/1998
JP 2000-194228 7/2000

* cited by examiner

*Primary Examiner*—Sandra Brase
(74) *Attorney, Agent, or Firm*—Oblon, Spivak, McClelland, Maier & Neustadt, P.C.

(57) ABSTRACT

A fixing device including a rotatable fixing member, a first heating device configured to heat the rotatable fixing member, a rotatable pressing member positioned in press-contact with the rotatable fixing member and forming a fixing region through which a sheet-like recording medium having an unfixed image thereon passes to fix the unfixed image by heat and pressure, and a controller configured to turn off the first heating device for a first predetermined time before a trailing edge of a last sheet-like recording medium in a series of a job passes through the fixing region.

26 Claims, 5 Drawing Sheets

FIXING DEVICE CAPABLE OF PREVENTING EXCESSIVE INCREASE IN TEMPERATURE

CROSS-REFERENCE TO RELATED APPLICATIONS

The present application claims priority to Japanese Patent Applications No. 2001-190225 and No. 2002-129882, file on Jun. 22, 2001 and May 1, 2002, respectively. The contents of those applications are incorporated herein by reference in their entirety.

BACKGROUND OF THE INVENTION

1. Field of the Invention

The present invention relates a fixing device to be used in an image forming apparatus, and more particularly to a fixing device capable of preventing an excessive increase in a temperature.

2. Discussion of the Background

In an image forming apparatus, such as a copying machine, a facsimile, a printer, and other similar devices, an unfixed image that has been transferred onto a recording medium, such as a transfer sheet is fixed by a fixing device and the recording medium is discharged as a hard copy. The fixing device includes a pair of rollers provided such that the rollers oppose each other, one functioning as a heating roller, and the other functioning as a pressure roller to press a recording medium during an image fixing operation. The recording medium having an unfixed image thereon is conveyed to a nip region formed between the heating roller and pressure roller where the unfixed image is fused and fixed onto the recording medium with heat of the heating roller.

In addition, a belt-type fixing device is commonly known. An example of the belt-type fixing device includes a belt, which is spanned around a pair of rollers. One of the pair of rollers is positioned to oppose a pressure roller. The other roller of the pair of rollers drives the belt together with the roller disposed at the position opposing the pressure roller and includes a heating source inside the roller. The heating source heats the belt while the roller contacting an inner surface of the belt. The pressure roller includes a heating source inside the roller to heat an outer surface of the belt. A volume and thermal capacity of a belt is smaller than a volume and thermal capacity of a roller. Thus, a temperature of the belt increases in a shorter period of time compared to that of the roller. An advantage of the belt-type fixing device includes a shorter warm-up time as compared to the fixing device employing the heating roller and pressure roller. In addition, because a heating source is provided inside the pressure roller, the belt is heated from both inner and outer surfaces thereof, resulting in a shorter warm-up time. In the belt-type fixing device, if the pressure roller and roller with the heating source are formed of aluminum having high thermal conductivity, the belt is formed of two-layer, namely, a releasing layer and a substrate. The releasing layer includes silicone rubber or fluorine resin and is layered on the substrate including a stainless steel.

The belt is heated by the below described methods. In a first method, an inner surface of the belt is heated by a heating source included inside a heating roller, i.e., a roller that drives the belt together with the roller provided at a position opposing the pressure roller. In a second method, an outer surface of the belt is heated by a heating source included inside the pressure roller and the inner surface of the belt is heated by the heating roller. Thus, both heating and pressure rollers include a thin cylindrically shaped core metal to have a small thermal capacity. A diameter of the core metal of the heating roller is set in a range of approximately 20 mm to approximately 30 mm. A thickness of the core metal of the heating roller is set in a range of approximately 0.3 mm to approximately 2.0 mm. A diameter of the core metal of the pressure roller is set in a range of approximately 30 mm to approximately 50 mm. A thickness of the core metal of the pressure roller is set in a range of approximately 0.3 mm to 1.5 mm. Thus, the heating roller and pressure roller have a thermal capacity of not greater than 26 cal/° C. and 36 cal/° C., respectively.

Immediately after a recording medium such as a transfer sheet passed through a fixing region, the respective heating sources in the heating roller and pressure roller produce an excessive amount of heat when a surface temperature of the heating roller and pressure roller is increased to a predetermined set temperature. This is because an amount of heat is absorbed by the recording medium and the surface temperature of the heating roller and pressure roller is decreased below the predetermined set temperature. Hence, an excessive heating phenomenon occurs. Thus, an excessive amount of heat is supplied to a following recording medium and causes a hot offset phenomenon or produces an adverse effect such as glossiness of an image. In addition, devices for inhibiting an excessive temperature increase, such as a thermal fuse and thermostat, are damaged due to an excessive increase in temperature in the apparatus.

SUMMARY OF THE INVENTION

According to one aspect of the present invention, a fixing device includes a rotatable fixing member, a first heating device configured to heat the rotatable fixing member, a rotatable pressing member positioned in press-contact with the rotatable fixing member and forming a fixing region through which a sheet-like recording medium having an unfixed image thereon passes to fix the unfixed image by heat and pressure, and a controller configured to turn off the first heating device for a first predetermined time before a trailing edge of a last sheet-like recording medium in a series of a job passes through the fixing region.

According to another aspect of the present invention, a fixing device includes a rotatable fixing member, a first heating device configured to heat the rotatable fixing member, a rotatable pressing member positioned in press-contact with the rotatable fixing member and forming a fixing region through which a sheet-like recording medium having an unfixed image thereon passes to fix the unfixed image by heat and pressure, a second heating device configured to heat the rotatable pressing member, a controller configured to turn off the first heating device for a first predetermined time before a trailing edge of a last sheet-like recording medium in a series of a job passes through the fixing region and turn off the second heating device for a second predetermined time before the trailing edge of the last sheet-like recording medium passes through the fixing region.

According to yet another aspect of the present invention, an image forming apparatus includes a photoreceptor configured to form a latent image thereon, and a fixing device including a rotatable fixing member, a first heating device configured to heat the rotatable fixing member, a rotatable pressing member positioned in press-contact with the rotatable fixing member and forming a fixing region through which a sheet-like recording medium having an unfixed image thereon passes to fix the unfixed image by heat and pressure, and a controller configured to turn off the first heating device for a first predetermined time before a trailing edge of a last sheet-like recording medium in a series of a job passes through the fixing region.

According to still yet another aspect of the present invention, an image forming apparatus includes a photoreceptor configured to form a latent image thereon, and a fixing device including a rotatable fixing member, a first heating device configured to heat the rotatable fixing member, a rotatable pressing member positioned in press-contact with the rotatable fixing member and forming a fixing region through which a sheet-like recording medium having an unfixed image thereon passes to fix the unfixed image by heat and pressure, a second heating device configured to heat the rotatable pressing member, and a controller configured to turn off the first heating device for a first predetermined time before a trailing edge of a last sheet-like recording medium in a series of a job passes through the fixing region and turn off the second heating device for a second predetermined time before the trailing edge of the last sheet-like recording medium passes through the fixing region.

According to still another aspect of the present invention, a method of fixing an image includes providing a rotatable fixing member, providing a first heating device configured to heat the rotatable fixing member, press-contacting the rotatable pressing member with the rotatable fixing member to form a fixing region through which a sheet-like recording medium having unfixed image thereon passes to fix the unfixed image by heat and pressure, and turning off the first heating device for a first predetermined time before a trailing edge of a last sheet-like recording medium in a series of a job passes through the fixing region.

According to still another aspect of the present invention, a method of fixing an image includes providing a rotatable fixing member, providing a first heating device configured to heat the rotatable fixing member, press-contacting the rotatable pressing member with the rotatable fixing member to form a fixing region through which a sheet-like recording medium having unfixed image thereon passes to fix the unfixed image by heat and pressure, providing a second heating device configured to heat the rotatable pressing member, turning off the first heating device for a first predetermined time before a trailing edge of a last sheet-like recording medium in a series of a job passes through the fixing region, and turning off the second heating device for a second predetermined time before the trailing edge of the last sheet-like recording medium passes through the fixing region.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
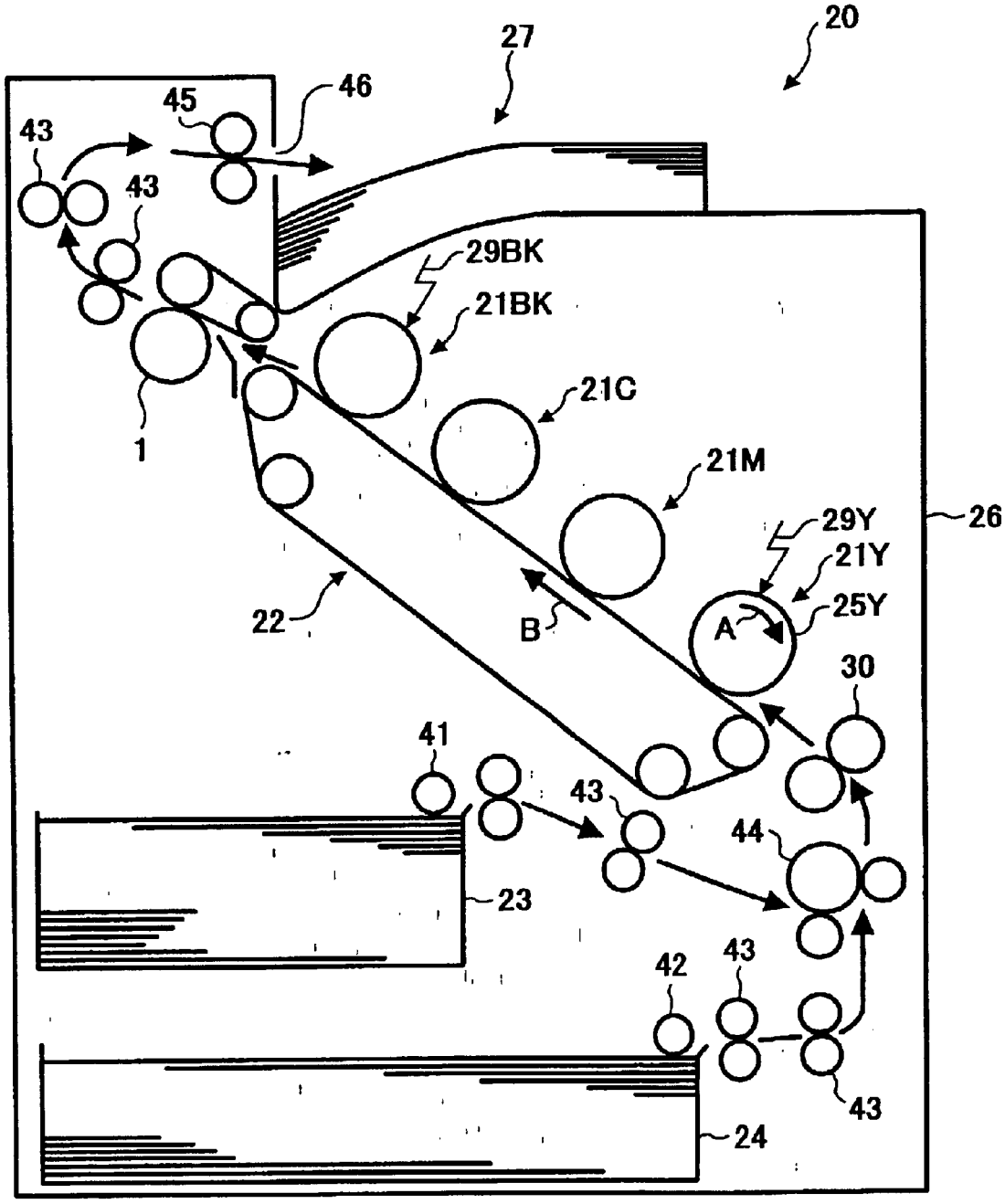
FIG. 1 is a schematic drawing illustrating a construction of an image forming apparatus using a fixing device according to an embodiment of the present invention.

Referring now to the drawings, wherein like reference numerals designate identical or corresponding parts throughout the several views, examples of the present invention are described below referring to the figures.

FIG. 1 is a schematic drawing illustrating a construction of an image forming apparatus 20 to be used in a copying machine or a printer capable of forming a full color image. The image forming apparatus 20 can also be used in a facsimile that forms an image in a similar manner as the above-described copying machine and printer. The facsimile forms the image based on a received image signal. The image forming apparatus 20 can also be used in a copying machine, printer, and facsimile that form a single color image.

The image forming apparatus 20 includes an image forming devices (21Y, 21M, 21C, 21BK), a transfer device 22 arranged at a position opposing the image forming devices (21Y, 21M, 21C, 21BK). The image forming apparatus 20 further includes sheet feeding cassettes 23, 24, a registration roller 30, and a fixing device 1. The sheet feeding cassettes 23, 24 feed various types and sizes of sheet-like recording media to a transfer region formed at a position where the transfer device 22 opposes the image forming devices (21Y, 21M, 21C, 21BK). The registration roller 30 feeds a sheet-like recording medium conveyed from the sheet feeding cassettes 23, 24 to the transfer region by adjusting a time such that the sheet-like recording medium is in precise register with images formed on the image forming devices (21Y, 21M, 21C, 21BK).

In the image forming apparatus 20, either a normal recording medium or a special recording medium may be used. The normal recording medium includes, for example, a plain paper that is generally used in a copier (hereinafter referred to as a normal recording medium). The special recording medium includes, for example, an overhead transparent film sheet, a card, a postcard, a thick paper having a base weight of about 100 g/m$^2$ or greater, and an envelope (hereinafter referred to as a special recording medium). The special recording medium generally has a larger thermal capacity than the normal recording medium.

The image forming devices, 21Y, 21YM, 21C, and 21BK, form yellow, magenta, cyan, and black-and-white toner images, respectively. Because their configurations are substantially the same except for the colors of toners used, the configuration of the image forming device (21Y) is described below as an example of each of the image forming devices. The image forming device (21Y) includes a photoconductive drum (25Y) as an electrostatic latent image bearing member. A charging device, developing device, cleaning device, and so forth (not shown) are arranged around the photoconductive drum (25Y) in the order of the rotating direction of the photoconductive drum (25Y) indicated by Arrow (A). A surface of the photoconductive drum (25Y) is exposed to an exposure light (29Y) emitted from a scanning device (not shown) including a polygon mirror which is provided between the charging device and developing device. A belt-shaped photoconductive element may be employed as the electrostatic latent image bearing member instead of the drum-shaped photoconductive element. In the image forming device (21BK), two beam lights (29BK) are emitted such that an image is formed more quickly as compared to an image forming operation performed in the other image forming devices (21Y, 21M, 21C).

A-4 size and A-3 size sheet-like recording media, for example, are longitudinally loaded in a horizontal direction in FIG. 1 in the sheet feeding cassettes 23, 24, respectively. The transfer device 22 is arranged in an oblique direction such that a size of the image forming apparatus 20 is minimized in the horizontal direction in FIG. 1. Thus, a sheet-like recording medium is conveyed in the oblique direction as indicated by Arrow (B). With this arrangement, a width of a housing 26 is reduced to a size which is slightly greater than the longitudinal length of an A-3 size sheet-like recording medium. Thus, the size of the image forming apparatus 20 is minimized such that it has a minimum necessary size to contain the sheet-like recording medium inside. A sheet discharge tray 27 is formed in the top surface of the housing 26 to stack a sheet-like recording medium having a toner image fixed by the fixing device 1.

In FIG. 1, reference numerals 41 and 42 denote pickup rollers that feed the sheet-like recording media from the sheet feeding cassettes 23, 24, respectively. Reference numerals 43 and 44 each denote a conveying roller for conveying the sheet-like recording medium and a roller mechanism which feeds the sheet-like recording medium conveyed from the sheet feeding cassettes 23, 24 to the registration roller 30. A reference numeral 45 denotes a discharging roller to discharge the sheet-like recording medium to the sheet discharge tray 27 from a sheet discharging outlet 46.

Figure 2:
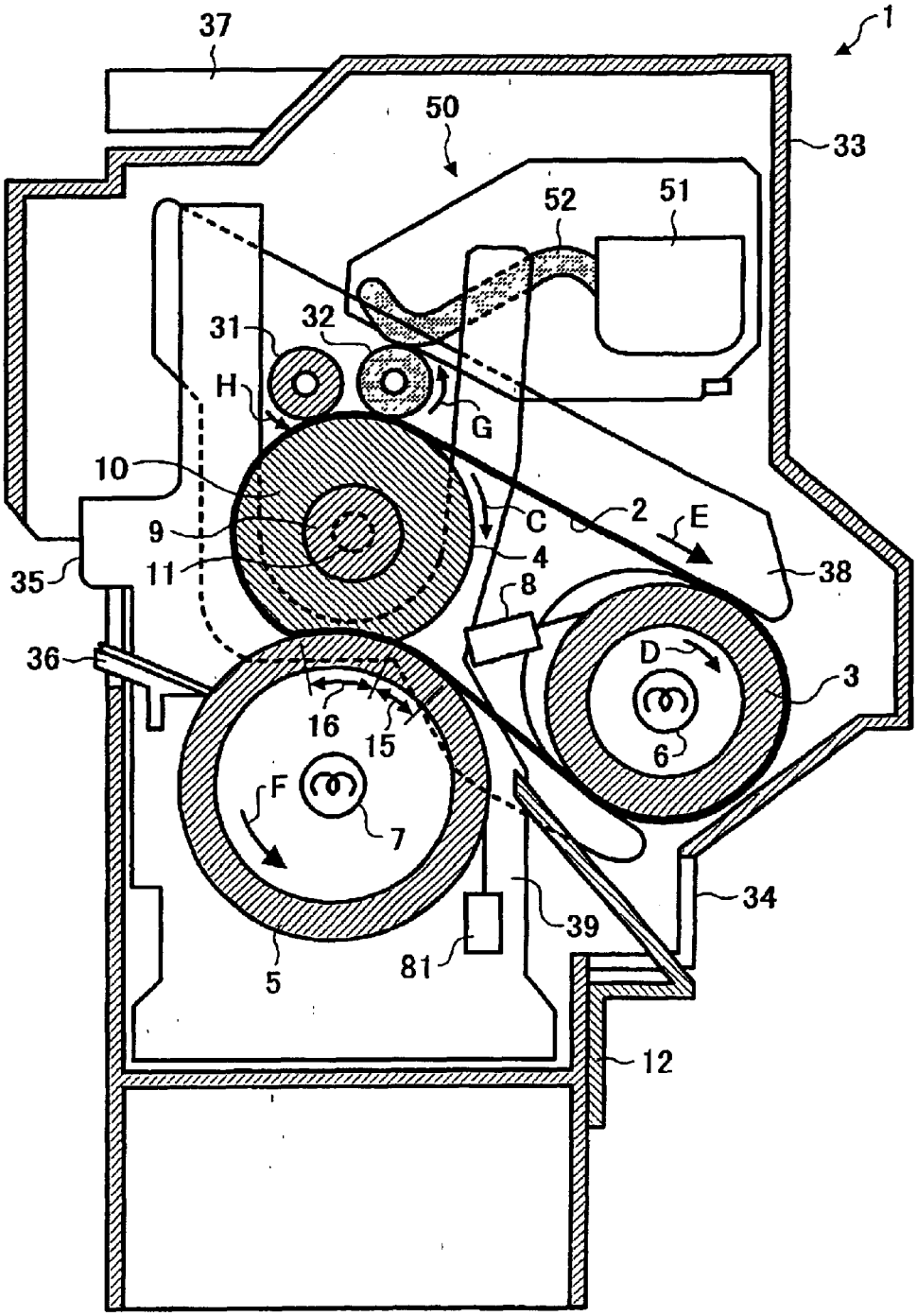
FIG. 2 is a schematic drawing illustrating a construction of the fixing device shown in FIG. 1.

As illustrated in FIG. 2, the fixing device 1 includes an endless fixing belt 2, a heating roller 3, a fixing roller 4, a pressure roller 5, a heater 6, i.e., a first heating source, a heater 7, i.e., a second heating source, and a thermistor 8. The endless fixing belt 2 which is a sheet-like recording medium conveying member conveys a sheet-like recording medium for fixing a toner image thereon. The fixing belt 2 is spanned around the heating roller 3. The pressure roller 5 is arranged at a position opposing the fixing roller 4 via the fixing belt 2. The heaters 6, 7 are provided inside the heating roller 3 and pressure roller 5, respectively. The thermistor 8 is arranged at a position opposing the heating roller 3 to abut against the heating roller 3. The thermistor 8, a temperature detecting device, detects a temperature of the heating roller 3. The fixing device 1 further includes a cleaning roller 31, a coating roller 32, a release agent supplying device 50, a casing 33, an inlet guide 12, an outlet guide 36, a handle 37, and a supporting member 38. The cleaning roller 31 is provided opposite to the fixing roller 4 via the fixing belt 2. The coating roller 32 which is a release agent coating member coats a release agent. The release agent supplying device 50 supplies the coating roller 32 with a release agent. The inlet guide 12, outlet guide 36, and handle 37 are fixedly provided on the casing 33. The supporting member 38 integrally supports the heating roller 3, fixing roller 4, and a fixing belt 2. In addition, a supporting member 39 which supports the supporting member 38 and pressure roller 5 with respect to the casing 33 is provided. It is preferable that the thermistor 8 detects the temperature of the heating roller 3 at a position where the heating roller 3 is in press-contact with the fixing belt 2. However, because the thermistor 8 is not provided at such a position, the thermistor 8 is provided to detect the temperature of the heating roller 3 at a position where the heating roller 3 is not in press-contact with the fixing belt 2, but still the temperature of the heating roller 3 is approximately equal to that of the heating roller 3 in press-contact with the fixing belt 2.

According to this embodiment of the present invention, the fixing device 1 includes the fixing belt 2 and pressure roller 5 to form a nip region in a fixing region; however, a fixing roller having a release agent layer around a core metal may be used instead of the fixing belt 2 and form the nip region between the fixing roller and pressure roller 5. In addition, a pressure belt may be used instead of the pressure roller 5, or the fixing belt and pressure belt may be used.

In order to give a predetermined suitable tension on the fixing belt 2, the heating roller 3 is biased in a direction away from the fixing roller 4 by a resilient member (not shown) such as a spring. The fixing roller 4 includes a core metal 9 and a heat-resistant elastic layer 10 which covers the core metal 9. A shaft 11 is rotatably driven by a driving device (not shown). Thus, the fixing roller 4 is rotatably driven in a direction indicated by Arrow (C). The fixing roller 4 rotatably drives the heating roller 3 in a direction indicated by Arrow (D), thereby driving the fixing belt 2 in a direction indicated by Arrow (E). Thus, the pressure roller 5 and coating roller 32 rotate in directions indicated by Arrows (F) and (G), respectively with the movement of the fixing belt 2.

The supporting members 38, 40 are biased in a direction such that they are brought closer together by a resilient member (not shown) such as a spring. Thus, the pressure roller 5 and the fixing roller 4 are biased in a direction of press-contacting each other with a pressing force, for example, 10 kgf or greater. The pressure roller 5 is in press-contact with the fixing roller 4 such that an angle formed between a line connecting the shaft centers of the fixing roller 4 and the heating roller 3 and a line connecting the shaft centers of the fixing roller 4 and the pressure roller 5 is an acute angle. With this arrangement, two fixing regions, i.e., first and second fixing regions 15, 16 are formed in a fixing area where a toner image is fixed onto a sheet-like recording medium. In the first fixing region 15, the pressure roller 5 does not contact the fixing roller 4, but contacts the fixing belt 2. In the second fixing region 16, the pressure roller 5 is in press-contact with the fixing roller 4 via the fixing belt 2. According to this embodiment of the present invention, the first and second fixing regions 15, 16 are referred to as a preheating position and a fixing region, respectively.

The casing 33 is provided at a position opposing the transfer device 22. The casing 33 includes an inlet 34 and an outlet 35. The inlet 34 receives a sheet-like recording medium conveyed from the transfer device 22. The outlet 35 is arranged on the opposite side of the inlet 34 having the first and second fixing regions 15, 16 therebetween. The sheet-like recording medium onto which a toner image has been fixed is discharged from the outlet 35. The base of the inlet guide 12 is fixed to the external surface of the casing 33 in the downward direction of the inlet 34. A tip portion of the inlet guide 12 goes into the inside of the casing 33 from the inlet 34 and is extended toward the first fixing region 15.

The fixing belt 2 includes a base member of 100 $\mu$m in thickness and made of nickel, and a releasing layer of 200

μm in thickness and made of silicone rubber layered on the base member. The fixing belt 2 has a low thermal capacity and a suitable thermo-response. The length of the fixing belt 2 is set such that the diameter is 60 mm when the fixing belt 2 is made into a circle. The base member may be made of stainless steel or polyimide. The thickness of the base member may be in a range of about 30 μm to about 150 μm considering its flexibility. When silicone rubber is employed for the releasing layer, the thickness of the releasing layer is preferably in a range of about 50 μm to about 300 μm. When fluororesin is employed for the releasing layer, the thickness of the releasing layer is preferably in a range of about 10 μm to about 50 μm. If the thickness of the releasing layer is large, a thermal capacity of the fixing belt 2 is increased, resulting in a long warm-up time or production of an adverse effect on a fixing operation. The releasing layer may have an alternative structure in which fluororesin is layered on silicone rubber. The above-described conditions are set so that the fixing belt 2 have a low thermal storage capacity. Namely, the fixing belt 2 is required to have a property such that the fixing belt 2 is quickly heated up and the surface of the fixing belt 2 is self-cooled in the fixing region without causing a hot offset problem in which a part of a fused toner image adheres to the fixing belt 2. On the other hand, the fixing belt 2 is required to have a thermal capacity necessary for fusing and fixing a toner image on a sheet-like recording medium in the fixing region. The above-described material and thickness of the fixing belt 2 meet such required conditions. The self-cooling of the fixing belt 2 includes a phenomenon in which the fixing belt 2 cools during a fixing operation in the fixing region because no heating source is provided on a surface side of a sheet-like recording medium on which an unfixed image is carried.

Because the heating roller 3 and the fixing roller 4 are biased in a direction in which the heating roller 3 and the fixing roller 4 are moving away from each other, the fixing belt 3 is tensioned at about 3 Kgf. The tension on the fixing belt 2 is adjusted by changing the biasing force of the resilient member (not shown). The tension on the fixing belt 2 may be preferably set in a range of about 1 Kgf (9.8N) to about 3 Kgf (29.4N) for a proper toner image fixing operation.

The heating roller 3 and the pressure roller 5 each include hollow cylindrical core metals such that they provide a low thermal capacity. The diameter of the core metal of the heating roller 3 is preferably set at a value which is equal to 20 mm or greater and equal to 30 mm or less, and the thickness of the core metal thereof is set at a value which is equal to 0.3 mm or greater and equal to 2.0 mm or less. The diameter of the core metal of the pressure roller 5 is preferably set at a value which is equal to 30 mm or greater and equal to 50 mm or less, and the thickness of the core metal thereof is set at a value which is equal to 0.3 mm or greater and equal to 1.5 mm or less. Thus, the thermal capacity of the heating roller 3 is set to approximately 26 cal/° C. or less, and the thermal capacity of the pressure roller 5 is set to approximately 36 cal/° C. or less.

In this embodiment of the present invention, the core metal of the heating roller 3 is made of aluminum. The diameter of the core metal of the heating roller 3 is set to 30 mm and the thickness thereof is set to 0.7 mm. The material of the core metal preferably has a low specific heat and high thermal conductivity. In place of aluminum, other metals such as iron, copper, stainless, etc., may be employed. For example, when the diameter of aluminum core metal of the heating roller is 30 mm, the thickness of the core metal may be set in a range of about 0.6 mm to about 1.4 mm. When the diameter of iron core metal of the heating roller 3 is 20 mm, the thickness of the core metal may be set in a range of about 0.7 mm to about 1.4 mm. When the diameter of iron core metal of the heating roller 3 is 30 mm, the thickness of the core metal may be set in a range of about 0.3 mm to about 0.9 mm. The reason why the thickness of the core metal is made smaller as the diameter thereof is increased is that the distortion of the heating roller 3 in the axial direction is obviated.

The above-described lower limit value of the thickness of the core metal represents an allowable level of value to obviate a deformation of the heating roller 3 caused by the above-described tension of the fixing belt 2. The upper limit value of the thickness of the core metal of the heating roller 3 represents an allowable level of value to accomplish a desired warm-up time. The reason why the diameter of the core metal is set to 20 mm or larger is that the required tension of the fixing belt 2 is maintained and that the distortion of the heating roller 3 in the axial direction thereof is obviated. Further, the reason why the diameter of the core metal is set in the range of about 20 mm to about 30 mm is to have the thermal capacity of about 26 cal/° C. so as to maintain the fixing belt 2 at a constant temperature required for a fixing operation even when a continuous fixing operation is performed with a conveying speed of a sheet-like recording medium at equal to 200 mm/s or less.

When the heating roller 3 has a low thermal capacity, the heating roller 3 does not largely absorb heat from the fixing belt 2 even when the fixing belt 2 is rotated, thereby preventing adverse effects on a fixing performance and avoiding a longer warm-up operation. In addition, even if the temperature is decreased, for example, by a continuous fixing operation, the time required to recover the temperature is shortened. The heater 6 heats the heating roller 3 and the fixing belt 2 via the heating roller 3. A temperature of the heater 6 is input to a control section 100 as a signal detected by the thermister 8. The input temperature is compared with a set temperature. When the detected temperature is lower than the set temperature, the heater 6 is switched on. When the detected temperature is higher than the set temperature, the heater 6 is switched off. Thus, the fixing temperature of the heating roller 3 is controlled based on the detection of the thermistor 8, and the surface temperature of the fixing belt 2 is maintained at 110° C. or higher. The thermistor 8 abuts against the heating roller 3 with an obtuse angle in the rotating direction of the heating roller 3 so as to reduce abrasion caused by friction between the thermistor 8 and the heating roller 3 produced when the heating roller 3 is rotated.

The elastic layer 10 of the fixing roller 4 includes a rubber layer made of rubber. More specifically, the material of the rubber for the rubber layer is silicone sponge rubber in the form of a foam. The diameter of the bubble is set to 500 μm. The diameter of the bubble in the vicinity of the surface of the fixing roller 4, i.e., in the vicinity of the four periphery planes of the fixing roller 4, is set to 300 μm or less. Because the elastic layer 10 is in the form of a foam, a reduction in the temperature of the fixing operation is suppressed. Because the elastic layer 10 is in the form of a foam, inconveniences such as an unsatisfactory glossy finish due to an insufficient fixing pressure, an uneven glossy finish due to surface roughness, etc., may be caused. However, such inconveniences are obviated by setting the diameter of the bubble as described above. Also, non-form layer, i.e., a so-called "skin layer", having the thickness of about 1 mm, may be formed on the surface of the elastic layer 10.

The surface hardness of the elastic layer 10 is set to 20HS or greater when measured by an "ASKER C" method, i.e., a method of measuring a hardness. When the surface hardness of the elastic layer 10 is equal to 20HS or greater, the surface roughness of the elastic layer 10 due to the foam does not affect image quality regardless of whether the elastic layer 10 includes the skin layer or not. Thus, a satisfactory image is produced without having an uneven glossy finish. The outer diameter of the fixing roller 4 is set to 30 mm. The elastic layer 10 includes a heat-resistant and porous elastic member having low thermal conductivity. Thus, the fixing roller 4 does not largely absorb heat from the fixing belt 2, thereby minimizing a decrease in the temperature of the fixing belt 2 after the warm-up operation is completed. Further, a period of time required for a pre-rotation of the fixing belt 2 to recover the temperature is reduced. Because the elastic layer 10 has a comparatively low hardness, a sufficient nip width is secured even if a pressing force of the pressure roller 5 is small. Thus, a high fixing performance is accomplished even under a low-temperature and low-pressure condition.

The core metal of the pressure roller 5 is made of iron. The diameter of the core metal of the pressure roller 5 is set to 40 mm and the thickness thereof is set to 1.0 mm. The material of the core metal preferably has a low specific heat and high thermal conductivity. Other metals such as aluminum, copper, stainless, etc., may be employed in place of iron. For example, when the diameter of the iron core metal of the pressure roller 5 is 30 mm, the thickness of the core metal may be set in a range of about 0.4 mm to about 1.0 mm. When the diameter of the iron core metal of the pressure roller 5 is 50 mm, the thickness of the core metal may be set in a range of about 0.3 mm to about 0.8 mm. When the diameter of aluminum core metal of the pressure roller 5 is 30 mm, the thickness of the core metal may be set in a range of about 1.3 mm to about 1.5 mm. When the diameter of the aluminum core metal of the pressure roller 5 is 50 mm, the thickness of the core metal may be set in a range of about 0.6 mm to about 1.2 mm. The reason why the thickness of the core metal is made smaller as the diameter thereof is increased is that the distortion of the pressure roller 5 in the axial direction is prevented.

The above-described lower limit value of the thickness of the core metal represents an allowable level of value to prevent a deformation of the pressure roller 5 caused by the pressure of 0.6 $Kg/cm^2$ corresponding to the lower limit value of the fixing pressure. The upper limit value of the thickness of the core metal of the pressure roller 5 represents an allowable level of value to accomplish a desired warm-up time. The reason why the diameter of the core metal is set to 30 mm or larger is that the required fixing pressure is maintained and that the distortion of the pressure roller 5 in the axial direction is prevented. Further, the reason why the diameter of the core metal is set in the range of 30 mm to 50 mm is to have a thermal capacity of about 36 cal/° C. so as to maintain the fixing belt 2 at a constant temperature required for a fixing operation even when a continuous fixing operation is performed.

When the pressure roller 5 has a low thermal capacity, the pressure roller 5 does not largely absorb heat from the fixing belt 2 even when the fixing belt 2 is rotated. According to this embodiment of the present invention, the pressure roller 5 includes the heater 7, thereby preventing ill effects exerted on a fixing performance due to a decrease in the temperature of the fixing belt 2 and a longer period of time required for the warm-up operation is avoided. Further, even if the temperature is decreased, for example, by the continuous fixing operation, the time required to recover the temperature is shortened. The heater 7 heats the pressure roller 5 to shorten the warm-up time and supplies heat to the underside of a sheet-like recording medium in a fixing operation to achieve a stable fixing performance. In addition, the pressure roller 5 may include a releasing layer in a range of about 10 $\mu$m to about 300 $\mu$m in thickness layered on the core metal. The heater 7 heats the pressure roller 5. The thermistor 81 detects a temperature of the pressure roller 5 and inputs the detected temperature to the control section 100 in a form of a signal. The detected temperature is compared with a set temperature. The heater 7 is switched on when the detected temperature is lower than the set temperature. To the contrary, the heater 7 is switched off when the detected temperature is higher than the set temperature. Thus, the temperature of the pressure roller 5 is controlled to maintain a surface temperature of the fixing belt 2 at 110° C. or greater. The thermistor 81 abuts against the pressure roller 5 with an obtuse angle in the rotating direction of the pressure roller 5 so as to reduce abrasion caused by friction between the thermistor 81 and the pressure roller 5 produced when the pressure roller 5 is rotated.

The reason why the thickness of the heating roller 3 and the pressure roller 5 is minimized such that they have a low thermal capacity is that the fixing belt 2 is employed in the fixing device 1. Because the fixing operation is performed in the comparatively long region, i.e., in the first and second fixing regions 15, 16, the fixing pressure is reduced, and strength of the pressure roller 5 is decreased. Further, because the pressure roller 5 does not press-contact with the heating roller 3, the thickness of the heating roller 3 and the pressure roller 5 is kept to a minimum. As described above, because the fixing operation is performed in the comparatively long region, the fixing operation is performed with a comparatively low temperature, thereby reducing the period of time required for the warm-up operation. Further, when the fixing belt 2 is employed, the fixing belt 2, which is heated by a heater, is cooled down to a suitable temperature for the fixing operation while the fixing belt 2 is rotated, thereby preventing a hot offset problem. An output of the heaters 6, 7 is set to 700W or less, considering a current which passes when a power switch is turned on or a flicker of a fluorescent lamp which occurs when the heater is turned on or off.

The cleaning roller 31 is arranged at a position adjacent to the coating roller 32 while the cleaning roller 31 is positioned on an upstream side of the coating roller 32 in the moving direction of the fixing belt 2. Both the cleaning roller 31 and the coating roller 32 abut against the fixing belt 2. The cleaning roller 31 and coating roller 32 are rotated by a driving device (not shown) in directions indicated by Arrows (H) and (G), respectively. Namely, the cleaning roller 31 and coating roller 32 are rotated at a position opposing the fixing belt 2 in the same direction and at the same speed at which the fixing belt 2 moves. The cleaning roller 31 abuts against the fixing belt 2 to wipe toner transferred onto the fixing belt 2 from a sheet-like recording medium. Thus, a surface of the fixing belt 2 is kept clean.

The coating roller 32 applies a predetermined amount of release agent, which is supplied from the release agent supplying device 50, to the fixing belt 2. A main component of the release agent is silicone oil. A contact/separation mechanism (not shown) controls a contact and separation operation of the release agent supplying device 50 with and from the fixing belt 2 so that the predetermined amount of release agent is applied to the fixing belt 2. The release agent supplying device 50 includes a coating device 52 that includes a release agent supplying section and a release agent recovery section. The release agent supplying section includes a pad-like fibrous member. One end of the fibrous member is immersed in a release agent contained in a release agent container 51 so that the fibrous member sucks up the release agent by capillary action. The other end of the fibrous member is extended to a position where the fibrous member contacts the coating roller 32. The release agent recovery section includes a pad-like fibrous member. One end of the fibrous member is provided to contact the coating roller 32 so as to recover an unconsumed release agent. The other end of the fibrous member is extended to the release agent container 51 to contain the recovered release agent therein.

As described above, the heater 6 and thermistor 8 are provided to the heating roller 3. The heater 6 heats the underside of the fixing belt 2. The thermistor 8 controls the heater 6. Similarly, the heater 7 and thermistor 81 are provided to the pressure roller 5. The heater 7 heats the surface of the fixing belt 2. The thermistor 81 controls the heater 7. The heating roller 3 and pressure roller 5 each include a cylindrical-shaped core metal to have a low thermal capacity. Thus, the heating roller 3 and pressure roller 5 quickly respond to an off/off operation of the heaters 6, 7. Hence, even if the thermistors 8, 39 detect that respective temperatures of the heating roller 3 and pressure roller 5 exceed a predetermined set temperature and turn off the heaters 6, 7, the heating roller 3 and pressure roller 5 may be heated to a temperature that is higher than the predetermined set temperature. When the heating roller 3 is heated to the temperature that is higher than the predetermined set temperature, the surface of the fixing belt 2 is excessively heated. The above-described phenomenon is likely to occur when surface temperatures of the fixing belt 2 and pressure roller 5 are decreased below the predetermined set temperature.

Figure 3:
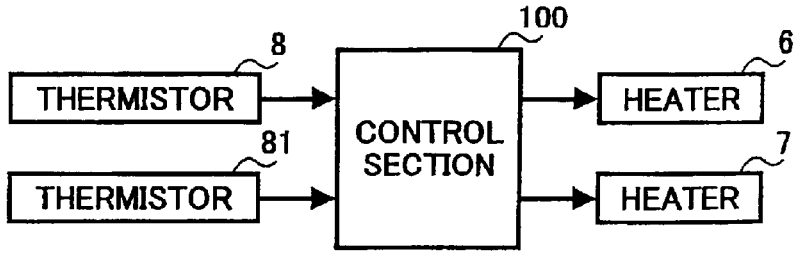
FIG. 3 is a block diagram illustrating a construction of a control section according to an embodiment of the present invention.

In FIG. 3, a control section 100 includes a microcomputer. The thermistors 8, 81 are connected to an input side of the control section 100 via an I/O interface (not shown). The heaters 6, 7 are connected to an output side of the control section 100. The control section 100 sets a surface temperature of each roller based on following conditions. (1) The heater 6, i.e., the first heating source, in the heating roller 3 is turned off for a first predetermined time before the trailing edge of the last sheet-like recording medium in a series of a job passes through the fixing region. The fixing region corresponds to the second fixing region 16 that is formed between a fixing member including a fixing belt or fixing roller and a pressure member including a pressure roller or pressure belt. The above-described job represents a unit of work in which the number of sheet-like recording media to be used in an image forming operation is set. (2) The first predetermined time includes a period of time in which a surface temperature of the fixing member in the fixing region is maintained at a predetermined temperature or higher until the trailing edge of the last sheet-like recording medium in the series of the job passes through the fixing region. (3) The first predetermined time is determined under a condition that the first predetermined time does not match the time when the trailing edge of the sheet-like recording medium passes through the fixing region. (4) If a length of the last sheet-like recording medium is shorter than a predetermined length, the heater 6 is turned off before the leading edge of the last sheet-like recording medium reaches the fixing region. (5) The period of the first predetermined time is adjusted according to the number of the sheet-like recording media in the series of the job. (6) When a belt spanned around a plurality of rollers is used as the fixing member, the first heating source is provided to one of the plurality of rollers that is disposed at a position other than the fixing region. The time when the first heating source is turned off is determined such that the time when the trailing edge of the last sheet-like recording medium in the series of the job passes through the fixing region approximately matches the time when a portion of the fixing member that has been heated by the time the first heating source is turned off reaches the fixing region. (7) The heater 6 is turned off for the first predetermined time before the trailing edge of the last sheet-like recording medium in the series of the job passes through the fixing region, and the heater 7, i.e., a second heating source, in the pressure roller 5 is turned off for a second period of time before the trailing edge of the last sheet-like recording medium in the series of the job passes through the fixing region. (8) In this case, the first and second predetermined times are set to a period of time in which the surface temperature of the fixing member in the fixing region is maintained at a predetermined temperature or higher until the trailing edge of the last sheet-like recording medium in the series of the job passes through the fixing region. (9) If the length of the last sheet-like recording medium is shorter than the predetermined length, at least one of the first and second heating sources, namely, the heaters 6, 7 is turned off before the leading edge of the last sheet-like recording medium reaches the fixing region. (10) The period of the time of at least one of the first and second predetermined times is adjusted according to the number of the sheet-like recording media in the series of the job. (11) After the last sheet-like recording medium has passed through the fixing region, at least one of set surface temperatures of the heating member and pressure member is decreased to a temperature that is lower than a predetermined set temperature. (12) At least one of the set surface temperatures of the heating member and pressure member is decreased after the last sheet-like recording medium in the series of the job has passed through the fixing region in a range that at least one of the surface temperatures of the heating member and pressure member increases to the predetermined set temperature before a first sheet-like recording medium in a series of a following job is conveyed to the fixing region.

Figure 4A:
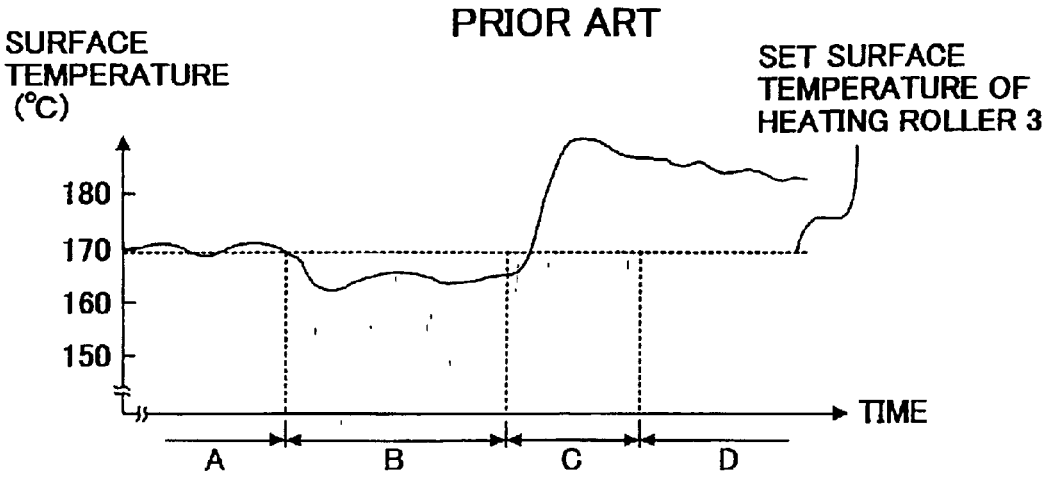
FIG. 4A PRIOR ART
FIGS. 4A and 4B are diagrams illustrating a change in a surface temperature of a conventional heating roller and pressure roller, respectively.
Figure 4B:
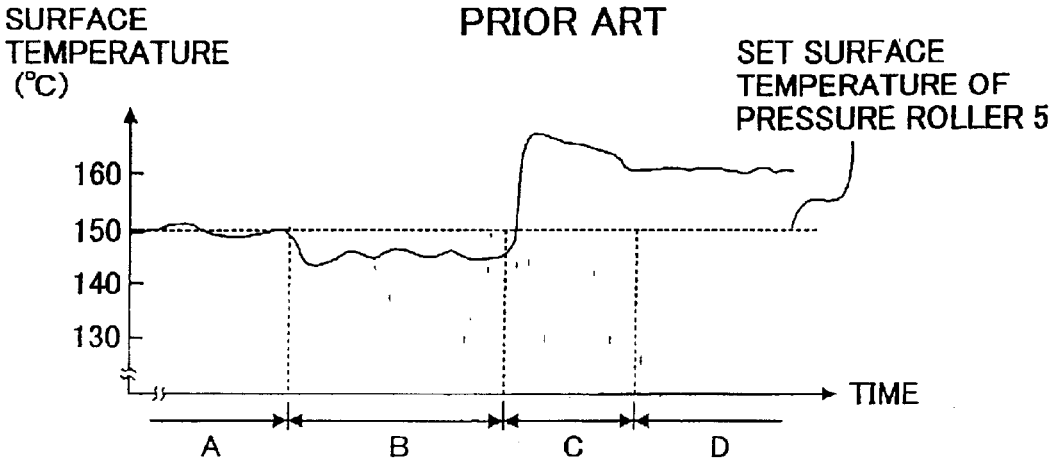
FIG. 4B PRIOR ART

A temperature setting based on the above-described conditions is described below. Changes in surface temperatures of the conventional heating roller and pressure roller are described referring to FIGS. 4A and 4B, respectively. Then, changes in the surface temperatures of the heating roller 3 and pressure roller 5 according to an embodiment of the present invention is described referring to FIGS. 5A and 5B, respectively. According to this embodiment of the present invention, a difference in the surface temperature between the heating roller 3 and fixing belt 2 is set at 20° C. Thus, the set surface temperature of the heating roller 3 and pressure roller 5 is set to 170° C. and 150° C., respectively, to have a difference in the set temperature by 20° C. FIGS. 4A and 4B show periods of time indicated by "A", "B", "C", and "D", respectively, wherein "A" represents a period when the apparatus is in a state of a pre-rotation before a sheet-like recording medium is conveyed to the fixing region, "B" represents a period when the sheet-like recording medium is being conveyed through the fixing region, "C" represents a period when a last sheet-like recording medium has been conveyed through the fixing region, but the driving mechanism of the apparatus is driven to discharge the sheet-like recording medium to the sheet discharging tray 27 provided on the top of the housing 26, thus keeping the fixing device 1 rotating, and "D" represents a period when the sheet-like recording medium is discharged to the sheet discharging tray 27 and the fixing device 1 stops the operation.

The surface temperature of the heating roller 3 is maintained at 170° C. in the period (A); however, in the period (B), the surface temperature of the heating roller 3 temporarily decreases by about 5° C. because an amount of heat is absorbed by a sheet-like recording medium. The heater 6 is then turned on. The surface temperature of the heating roller 3 starts to increase in the period (C) because the sheet-like recording medium has passed through a fixing region. When the thermistor 8 detects that the surface temperature of the heating roller 3 is higher than the set surface temperature, the heater 6 is turned off. However, due to a slow response of the heater 6, the surface temperature of the heating roller 3 exceeds the set surface temperature. In the period (D), the surface temperature of the heating roller 3 is maintained at a temperature higher than the set surface temperature by 10° C. or more because the fixing device 1 stops the operation and the heat of the heating roller 3 is not absorbed by the fixing belt 2.

Similarly, the surface temperature of the pressure roller 5 is maintained at 150° C. in the period (A); however, in the period (B), the surface temperature of the pressure roller 5 temporarily decreases about 5° C. because an amount of heat is absorbed by a sheet-like recording medium. The heater 7 is then turned on. Because the thermistor 81 is provided to a position closer to the nip region than the thermistor 8, the heater 7 is quickly turned on compared to the heater 6 of the heating roller 3. Thus, the surface temperature of the pressure roller 5 quickly increases compared to that of the heating roller 3. The surface temperature of the pressure roller 5 starts to increase in the period (C) because the sheet-like recording medium has passed through the fixing region. When the thermistor 81 detects that the surface temperature of the pressure roller 5 is higher than the set surface temperature, the heater 7 is turned off. However, due to a slow response of the heater 7, the surface temperature of the pressure roller 5 exceeds the set surface temperature. In the period (D), the surface temperature of the pressure roller is maintained at a temperature higher than the set surface temperature by 10° C. or more because the fixing device 1 stops the operation and the heat of the pressure roller 5 is not absorbed by the fixing belt 2.

Figure 5A:
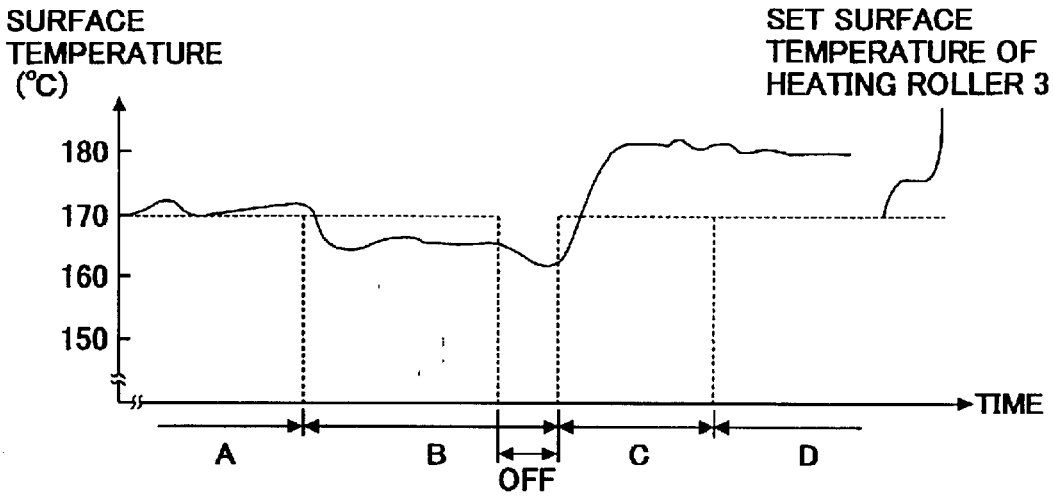
FIGS. 5A and 5B are diagrams illustrating a change in a surface temperature of a heating roller and pressure roller, respectively, according to an embodiment of the present invention.
Figure 5B:
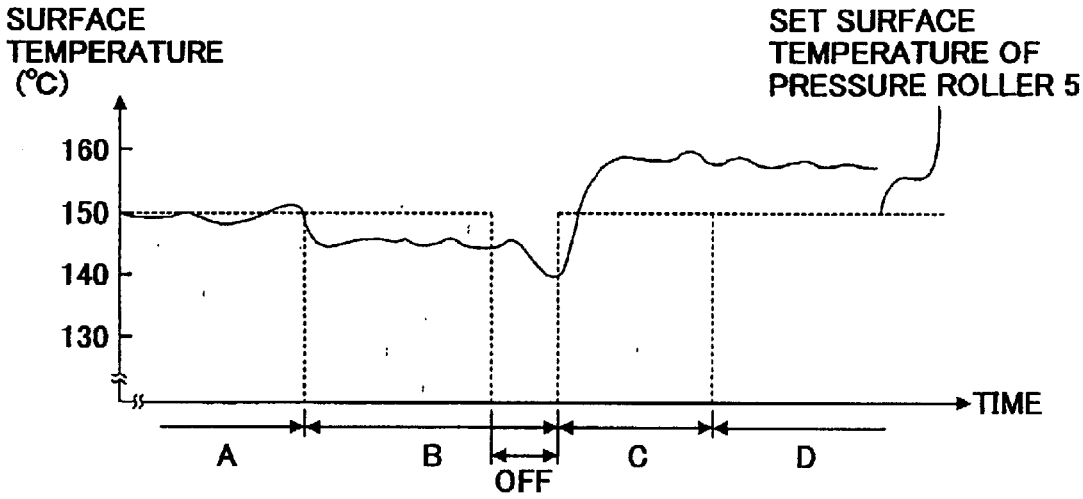

FIGS. 5A and 5B are diagrams illustrating changes in surface temperatures of the heating roller 3 and pressure roller 5, respectively according to the above-described conditions (1) and (2). As in the case of the conventional heating roller and pressure roller described referring to FIGS. 4A and 4B, a difference in the surface temperature between the heating roller 3 and fixing belt 2 is set at 20° C. Thus, the set surface temperatures of the heating roller 3 and pressure roller 5 is set to 170° C. and 150° C., respectively.

Similar to the case in the conventional heating roller and pressure roller described referring to FIGS. 4A and 4B, periods (A), (B), (C), and (D) respectively represent periods wherein the apparatus is in a state of a pre-rotation before a sheet-like recording medium is conveyed to the fixing region, wherein the sheet-like recording medium is being conveyed through the fixing region, wherein the last sheet-like recording medium has been conveyed through the fixing region; however, the driving mechanism of the apparatus is driven to discharge the sheet-like recording medium to the sheet discharging tray 27 provided on the top of the housing 26. Thus, the fixing device 1 keeps on rotating, and wherein the sheet-like recording medium is discharged to the sheet discharging tray 27 and the fixing device 1 stops the operation.

The surface temperature of the heating roller 3 is maintained at the set temperature of 170° C. in the period (A); however, in the period (B), the surface temperature of the heating roller 3 temporarily decreases approximately 5° C. because an amount of heat is absorbed by a sheet-like recording medium. The heater 6 is then turned on. Then, the heater 6 is turned off for a predetermined period of time immediately before the time elapses to reach the period (C).

The heater 6 is turned off before the last sheet-like recording medium in a series of a job passes through the fixing region 16 based on the above-described conditions (1) and (2). The time when the heater 6 is turned off may be set in a following manner, for example. The time when the trailing edge of the last sheet-like recording medium in the series of the job passes through the fixing region 16 is calculated based on the time when the trailing edge of the last sheet-like recording medium passes through the registration roller 30 (see FIG. 1) and an imaging linear velocity. The time when the heater 6 is turned off is then set based on the first predetermined time that satisfies the above-described condition (2), referring to the calculated time when the trailing edge of the last sheet-like recording medium passes through the fixing region 16. A sensor (not shown) is used to detect the time when the trailing edge of the last sheet-like recording medium passes through the registration roller 30.

The above-described condition (3) is used as a reference to determine the first predetermined time. The condition (3) is set to ensure that an excessive heating phenomenon is prevented at the time when the trailing edge of a sheet-like recording medium passes through the fixing region, as the heater 6 is turned off under the condition (2). If the first predetermined time is set to zero, the heater 6 is turned off approximately at the same time when the trailing edge of the sheet-like recording medium passes through the fixing region. Thus, a portion of the fixing belt 2 (including a case where a roller is used instead of a belt) positioned immediately after the trailing edge of the sheet-like recording medium is maintained at a high temperature because the portion of the fixing belt 2 has been heated. In addition, the temperature of the portion of the fixing belt 2 is not decreased because no sheet-like recording medium that absorbs heat exists in the fixing region. Thus, the excessive heating phenomenon is likely to occur. According to this embodiment of the present invention, the apparatus is prevented from being in a situation in which the excessive heating phenomenon is likely to occur by setting the condition (3).

The heater 6 is turned off the first predetermined time before the trailing edge of the last sheet-like recording medium in the series of the job passes through the fixing position; however, turning the heater 6 off does not produce an adverse effect on a fixing performance. A temperature of the fixing region 16 does not sharply decrease while a sheet-like recording medium is passing through a fixing device because a response of the heater 6 is slow, and the fixing unit is heated. Thus, a level of fixing performance is not decreased. According to the present invention, the heater 6 is not turned off so quickly such that it may adversely effect on the fixing performance.

The above-described first predetermined time is set with respect to a length of a sheet-like recording medium. Thus, a sheet-like recording medium may pass through the fixing region 16 or the sheet-like recording medium may not reach the fixing region 16 during the first predetermined time depending on a size of the sheet-like recording medium. For example, if the sheet-like recording medium is A-3 size, the sheet-like recording medium passes through the fixing region 16; however, if the sheet-like recording medium is A-4 size, the sheet-like recording medium would not reach the fixing region 16. The heater 6 is appropriately turned off even if the short length sheet-like recording medium is used as described in the above condition (4).

In another embodiment of the present invention, the time when the heater 6 is turned off is adjusted according to the total number of sheet-like recording media in a series of a job. Namely, when the number of sheet-like recording media pass through the fixing region 16 in sequence is large, the fixing device is correspondingly heated. Then, an excessive heating phenomenon tends to occur. Thus, the time when the heater 6 is turned off is adjusted based on the above-described condition (5). For example, the first predetermined time may be prolonged as the number of sheet-like recording media is increased to prevent the occurrence of the excessive heating phenomenon. The time when the heater 6 is turned off may be adjusted according to a property of a fixing device. The heater 6 may be turned off when a sheet-like recording medium before the last sheet-like recording medium is in the fixing device, i.e., a plurality of sheet-like recording media may exist between the sheet-like recording media and the last sheet-like recording medium.

Another embodiment of the present invention is described below. In this embodiment, the time when the heater 6 is turned off is controlled wherein the heater 6 is provided to the heating roller 3 and the fixing belt 2 is employed as a fixing member. The above-described condition (6) relates to this example. A temperature of the fixing belt 2, which is heated by the heater 6, is decreased while the fixing belt 2 moves from the heating roller 3 to the fixing region because a sheet-like recording medium contacting the fixing belt 2 absorbs heat of the fixing belt 2. However, if the fixing belt 2 is heated without having the sheet-like recording medium thereon, the fixing belt 2 is excessively heated. Thus, it is preferable that the temperature of the fixing belt 2, which passes through the fixing region when the trailing edge of the last sheet-like recording medium passed through the fixing region, is decreased to prevent an excessive heating of the fixing belt 2. Hence, the time when the heater 6 is turned off is set based on the condition (6) referring to the moving time of the fixing belt 2.

According to the condition (6), the timing of turning off the heater 6 is set such that the time when the trailing edge of the last sheet-like recording medium in a series of a job passes through the fixing region approximately matches the time when a portion of the fixing belt 2 that has been heated by the time when the first heating source is turned off reaches the fixing region. Thus, the heater 6 is turned off at the time in which the temperature of the fixing belt 2 is gradually decreased until the fixing belt 2 reaches the fixing region. Then, an excessive heating on a portion of the fixing belt 2 reaching the fixing region after the trailing edge of a sheet-like recording medium passes through the fixing region is prevented.

In this case, a distance in which the fixing belt 2 travels from a heated region (where a portion of the fixing belt 2 windingly contacts the heating roller 3) to the fixing region corresponds to a distance in which the fixing belt 2 travels from the fixing region to a position where the fixing belt 2 first contact the heating roller 3 in addition to a distance in which the fixing belt 2 windingly contacts the heating roller 3. Thus, the above-described time may be determined referring to a time in which the fixing belt 2 travels the above-described distance and a distance from the fixing region to the trailing edge of the sheet-like recording medium.

According to yet another embodiment of the present invention, at least one of the heaters 6, 7 is controlled. A surface temperature of the pressure roller 5 is maintained at the set temperature of 150° C. in the period (A); however, in the period (B), the surface temperature of pressure roller 5 temporarily decreases approximately 5° C. because an amount of heat is absorbed by a sheet-like recording medium. The heater 7 as a second heating source is then turned on. Then, the heater 7 is turned off for a predetermined period of time, i.e., a second predetermined time, immediately before the time elapses to reach the period (C).

The heater 7 is turned off before the last sheet-like recording medium in a series of a job passes through the fixing region 16 based on the above-described conditions (7) and (8). The time when the heater 7 is turned off may be set in a following manner, for example. The time when the trailing edge of the last sheet-like recording medium in the series of the job passes through the fixing region 16 is calculated based on the time when the trailing edge of the last sheet-like recording medium passes through the registration roller 30 (see FIG. 1) and an imaging linear velocity. The time when the heater 7 is turned off is then set based on the second predetermined time that satisfies the above-described condition (8), referring to the calculated time when the trailing edge of the last sheet-like recording medium passes through the fixing region 16. A sensor (not shown) is used to detect the time when the trailing edge of the last sheet-like recording medium passes through the registration roller 30.

The heater 7 is turned off for the second predetermined time before the trailing edge of the last sheet-like recording medium in the series of the job passes through the fixing position; however, turning the heater 7 off does not produce an adverse effect on a fixing performance due to the same reason as described referring to the heater 6. A release layer having a thickness of 200 $\mu$m is formed around a core metal of the pressure roller 5. The pressure roller 5 has a thermal capacity of not greater than 36 cal/° C. while the heating roller 3 has the thermal capacity of not greater than 26 cal/° C. Thus, a temperature charge in the pressure roller 5 is smaller than that in the heating roller 3. Hence, the heater 7 is not necessarily turned off at the same timing as that of the heater 6. As illustrated in FIG. 2, the heating roller 3 is distant from the fixing region 16. Then, the time is required before a portion of the fixing belt 2 contacting the heating roller 3 at the time when the heater 6 is turned off reaches the fixing region 16. Thus, the heaters 6, 7 are turned off at the same time as a result.

The above-described second predetermined time is set with respect to a length of a sheet-like recording medium. Thus, a sheet-like recording medium may pass through the fixing region 16 or the sheet-like recording medium may not reach the fixing region 16 during the second predetermined time depending on a size of the sheet-like recording medium. For example, if the sheet-like recording medium is A-3 size, the sheet-like recording medium passes through the fixing region 16; however, if the sheet-like recording medium is A-4 size, the sheet-like recording medium does not reached the fixing region 16. The heater 7 is appropriately turned off even if the short length sheet-like recording medium is used as described in the above condition (9).

The time when the heater 7 is turned off is adjusted according to the total number of sheet-like recording media in a series of a job. Namely, when the number of sheet-like recording media pass through the fixing region 16 in sequence is large, the fixing device is correspondingly heated. Then, an excessive heating phenomenon tends to occur. Thus, the time when the heater 7 is turned off is adjusted based on the above-described condition (10). For example, the second predetermined time may be prolonged as the number of sheet-like recording media is increased to prevent the occurrence of the excessive heating phenomenon. The time when the heater 7 is turned off may be adjusted according to a property of the fixing device.

As described above, the time when the heaters 6, 7 are turned off is determined on a basis of the trailing edge of a sheet-like recording medium. Thus, a variance in an amount of heat absorbed after the heaters 6, 7 are turned off is decreased. Then, a variance in a surface temperature of the heating roller 3 and pressure roller 5 after the last sheet-like recording medium in a series of a job has passed through the fixing region 16 is minimized, resulting in an easy control of the surface temperatures of the heating roller 3 and pressure roller 5 to prevent an excessive heating phenomenon.

Figure 6A:
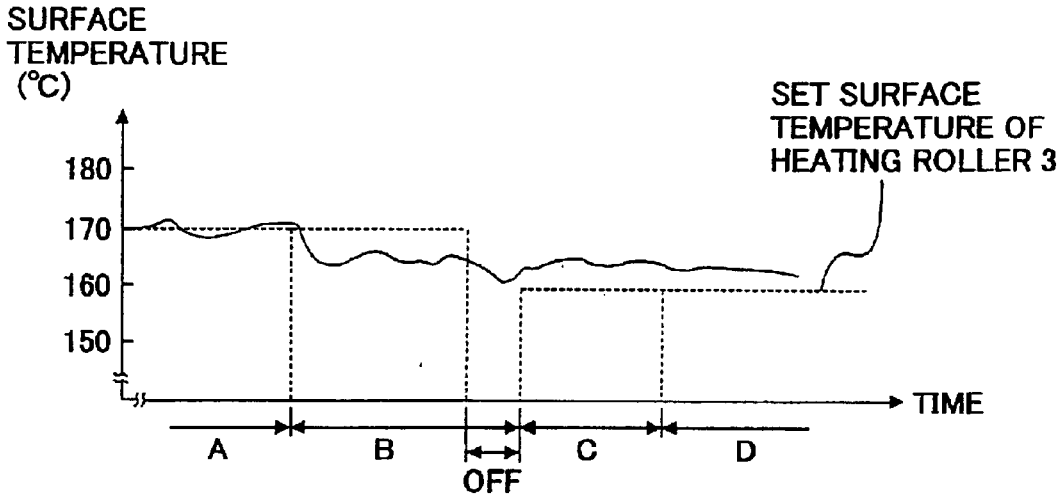
FIGS. 6A and 6B are diagrams illustrating a change in a surface temperature of a heating roller and pressure roller, respectively, according to another embodiment of the present invention.
Figure 6B:
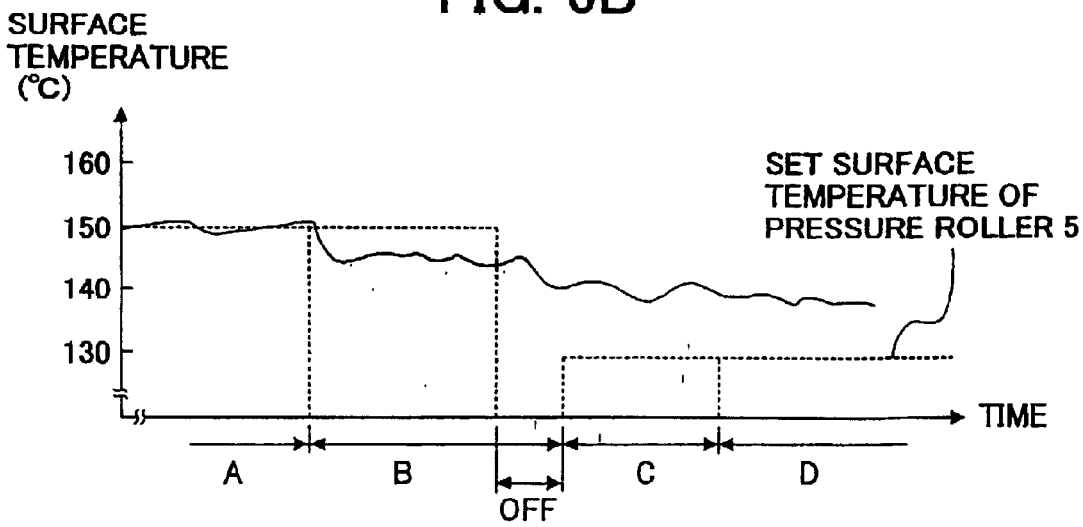

FIGS. 6A and 6B are diagrams illustrating changes in surface temperatures of the heating roller 3 and pressure roller 5, respectively, based on the above-described conditions (11) and (12). The surface temperature of the heating roller 3 is maintained at the set temperature of 170° C. in the period (A); however, in the period (B), the surface temperature of the heating roller 3 temporarily decreases approximately 5° C. The heater 6 is then turned on. As illustrated in FIG. 6A, the set temperature of the heating roller 3 decreases 10° C. at the same time when the time has elapsed to reach the period (C), after the heater 6 is turned off for a predetermined time. Though the sheet-like recording medium that absorbs heat has passed through the fixing region 16, the heater 6 is not turned on because the surface temperature of the heating roller 3 is decreased by approximately 10° C. due to a turning off of the heater 6, thereby an occurrence of the excessive heating phenomenon is prevented. Thus, the surface temperature of the heating roller 3 is maintained at a temperature between the set temperature, i.e., 170° C. and a temperature in which an image can be formed, i.e., 160° C. Even though the fixing device 1 stops the operation in the period (D), the surface temperature of the heating roller 3 is maintained in the above-described range.

The surface temperature of the pressure roller 5 is maintained at the set temperature of 150° C. in the period (A); however, in the period (B), the surface temperature of the pressure roller 5 temporarily decreases approximately 5° C. The heater 7 is then turned on. As illustrated in FIG. 6B, the set temperature of the pressure roller 5 decreases 20° C. at the same time when the time has elapsed to reach the period (C), after the heater 7 is turned off for a predetermined time. This is due to the fact that a temperature change in the pressure roller 5 is smaller than that of the heating roller 3 because a release layer having a thickness of 200 $\mu$m is provided around a core metal of the pressure roller 5. Thus, the pressure roller 5 has a thermal capacity of not greater than 36 cal/° C. while the heating roller 3 has the thermal capacity of not greater than 26 cal/° C.

Though the sheet-like recording medium that absorbs heat has passed through the fixing region 16, the heater 6 is not turned on because the surface temperature of the pressure roller 5 is decreased by approximately 10° C. as compared with the set surface temperature due to a turning off of the heater 7, thereby an occurrence of the excessive heating phenomenon is prevented. Thus, the surface temperature of the pressure roller 5 is maintained at a temperature between the set temperature, i.e., 150° C., and a temperature in which an image can be formed, i.e., 130° C. Even though the fixing device 1 stops the operation in the period (D) in FIG. 6B, the surface temperature of the pressure roller 5 is maintained in the above-described range.

With the above-described arrangement, because an excessive increase in temperature in the heating roller 3 and pressure roller 5 after a sheet-like recording medium has passed through the fixing region 16 is prevented, a hot offset phenomenon and an occurrence of a malfunction in a device for inhibiting an excessive temperature increase are prevented.

Although the set surface temperatures of the heating roller 3 and pressure roller 5 are decreased by 10° C. and 20° C., respectively, when the last sheet-like recording medium has passed through the fixing region 16, the set surface temperatures of the heating roller 3 and pressure roller 5 are increased to respective predetermined set temperatures before a sheet-like recording medium for a following image forming operation is conveyed to the image forming device (21BK) disposed at a position nearest to the fixing device 1 according to the above-described condition (12). Thus, the operation performed according to the above-described condition (9) does not adversely affect the following image forming operation.

Figure 7:
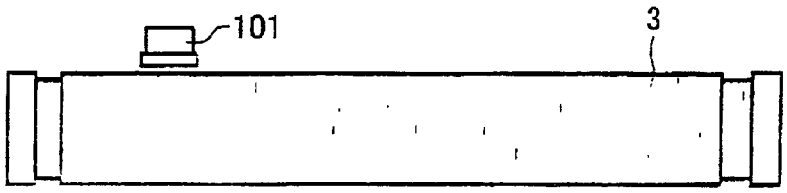
FIG. 7 is a schematic drawing illustrating a device for inhibiting an excessive temperature increase.

Next, still another embodiment of the present invention is described below. As illustrated in FIG. 7, the heating roller 3 includes a thermostat as a device for inhibiting an excessive temperature increase 101. The device 101 turns off the heater 6 when the heating roller 3 is heated above a predetermined temperature to prevent smoking or firing of the heating roller 3. The device 101 is provided to contact the heating roller 3. The device 101 turns off the heater 6 when the heating roller 3 is heated to 200° C. and above.

According to the above-described conditions, the set temperature of the heating roller 3 is set at 170° C.; however, the set surface temperature of the heating roller 3 is adjustable to 180° C. for a thick sheet-like recording medium. Thus, if the set surface temperature of the heating roller 3 is set to 180° C., the surface temperature of the heating roller 3 may increase to approximately 200° C. by a conventional method. Then, the device 101 is damaged and a service technician needs to replace it with a new one. According to this embodiment of the present invention, the surface temperature of the heating roller 3 is controlled based on the above-described conditions. Hence, an excessive temperature increase in the heating roller 3 is prevented and the device for inhibiting excessive temperature increase 101 properly functions, resulting in a safe image forming apparatus.

In addition, if a thermal fuse is used as the device for inhibiting excessive temperature increase inhibiting device 101, costs of the device 101 is decreased as compared to a thermostat.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A fixing device comprising:

a rotatable fixing member;

a heating device configured to heat the rotatable fixing member, a rotatable pressing member positioned in press-contact with the rotatable fixing member and forming a fixing region through which a sheet-like recording medium passes to fix an unfixed image by heat and pressure; and a controller configured to turn off the heating device for a predetermined time before a trailing edge of a last sheet-like recording medium in a series of a job passes through the fixing region.

2. The fixing device according to claim 1, wherein the predetermined time is set to a period of time in which a surface temperature of the rotatable fixing member in the fixing region is maintained at a predetermined temperature or higher until the trailing edge of the last sheet-like recording medium passes through the fixing region.

3. The fixing device according to claim 1, wherein the predetermined time is determined under a condition that the predetermined time does not match a time when the trailing edge of the sheet-like recording medium passes through the fixing region.

4. The fixing device according to claim 1, wherein the controller is configured to turn off the heating device before a leading edge of the last sheet-like recording medium reaches the fixing region, when a length of the last sheet-like recording medium is shorter than a predetermined length.

5. The fixing device according to claim 1, wherein the predetermined time is adjusted according to a total number of sheet-like recording media in the series of the job.

6. The fixing device according to claim 1, wherein the rotatable fixing member comprises a plurality of rollers and a belt spanned around the plurality of rollers, wherein the heating device is configured to heat at least one of the plurality of rollers.

7. The fixing device according to claim 6, wherein:

the heating device is configured to heat one of the plurality of rollers which is disposed at a position other than the fixing region; and the predetermined time is determined such that the trailing edge of the sheet-like recording medium passes through the fixing region when a portion of the rotatable fixing member heated by a time when the heating device is turned off reaches the fixing region.

8. The fixing device according to claim 7, wherein a set surface temperature of the one of the plurality of rollers including the heating device is decreased to a temperature lower than a predetermined set temperature after the last sheet-like recording medium has passed through the fixing region.

9. The fixing device according to claim 8, wherein the set surface temperature of the one of the plurality of rollers including the heating device is decreased after the last sheet-like recording medium has passed through the fixing region in a range that the surface temperature of the one of the plurality of rollers including the heating device increases to the predetermined set temperature before a first sheet-like recording medium in a series of a following job is conveyed to the fixing region.

10. The fixing device according to claim 1, wherein the controller comprises a computer device and one of a thermistor and a thermostat.

11. A fixing device comprising:

a rotatable fixing member;

a first heating device configured to heat the rotatable fixing member;

a rotatable pressing member positioned in press-contact with the rotatable fixing member and forming a fixing region through which a sheet-like recording medium passes to fix an unfixed image by heat and pressure;

a second heating device configured to heat the rotatable pressing member;

a controller configured to turn off the first heating device for a first predetermined time before a trailing edge of a last sheet-like recording medium in a series of a job passes through the fixing region and turn off the second heating device for a second predetermined time before the trailing edge of the last sheet-like recording medium passes through the fixing region.

12. The fixing device according to claim 11, wherein the first and second predetermined times are set to a period of time in which a surface temperature of the rotatable fixing member in the fixing region is maintained at a predetermined temperature or higher until the trailing edge of the last sheet-like recording medium passes through the fixing region.

13. The fixing device according to claim 11, wherein the controller is configured to turn off at least one of the first and second heating devices before a leading edge of the last sheet-like recording medium reaches the fixing region, when a length of the last sheet-like recording medium is shorter than a predetermined length.

14. The fixing device according to claim 11, wherein at least one of the first predetermined time and second predetermined time is adjusted according to a total number of sheet-like recording media in the series of the job.

15. The fixing device according to claim 11, wherein the rotatable fixing member comprises a plurality of rollers and a belt spanned around the plurality of rollers, wherein one of the plurality of rollers has the first heating device therein, and the rotatable pressing member comprises a pressure roller having the second heating device in side.

16. The fixing device according to claim 15, wherein at least one of a set surface temperature of the one of the plurality of rollers including the first heating device and a set surface temperature of the rotatable pressing member is decreased to a temperature lower than respective predetermined set surface temperatures after the last sheet-like recording medium has passed through the fixing region.

17. The fixing device according to claim 16, wherein at least one of the set surface temperatures of the one of the plurality of rollers including the first heating device and rotatable pressing member is decreased after the last sheet-like recording medium has passed through the fixing region in a range that at least one of the surface temperatures of the one of the plurality of rollers including the first heating device and rotatable pressing member increases to the respective predetermined set temperatures before a first sheet-like recording medium in a series of a following job is conveyed to the fixing region.

18. The fixing device according to claim 11, wherein the controller comprises a computer device and one of a thermistor and a thermostat.

19. An image forming apparatus comprising:

a photoreceptor configured to form a latent image thereon; and a fixing device including:

a rotatable fixing member;

a heating device configured to heat the rotatable fixing member;

a rotatable pressing member positioned in press-contact with the rotatable fixing member and forming a fixing region through which a sheet-like recording medium passes to fix an unfixed image by heat and pressure; and a controller configured to turn off the heating device for a predetermined time before a trailing edge of a last sheet-like recording medium in a series of a job passes through the fixing region.

20. The fixing device according to claim 19, wherein the controller comprises a computer device and one of a thermistor and a thermostat.

21. An image forming apparatus comprising:

a photoreceptor configured to form a latent image thereon; and a fixing device including, a rotatable fixing member;

a first heating device configured to heat the rotatable fixing member;

a rotatable pressing member positioned in press-contact with the rotatable fixing member and forming a fixing region through which a sheet-like recording medium passes to fix an unfixed image by heat and pressure;

a second heating device configured to heat the rotatable pressing member; and a controller configured to turn off the first heating device for a first predetermined time before a trailing edge of a last sheet-like recording medium in a series of a job passes through the fixing region and turn off the second heating device for a second predetermined time before the trailing edge of the last sheet-like recording medium passes through the fixing region.

22. The fixing device according to claim 21, wherein the controller comprises a computer device and one of a thermistor and a thermostat.

23. A method of fixing an image, comprising:

providing a rotatable fixing member and a rotatable pressing member;

providing a heating device configured to heat the rotatable fixing member;

press-contacting the rotatable pressing member with the rotatable fixing member to form a fixing region through which a sheet-like recording medium passes to fix an unfixed image by heat and pressure; and turning off the heating device for a predetermined time before a trailing edge of a last sheet-like recording medium in a series of a job passes through the fixing region.

24. A method of fixing an image, comprising:

providing a rotatable fixing member and a rotatable pressing member;

providing a first heating device configured to heat the rotatable fixing member;

press-contacting the rotatable pressing member with the rotatable fixing member to form a fixing region through which a sheet-like recording medium passes to fix an unfixed image by heat and pressure;

providing a second heating device configured to heat the rotatable pressing member;

turning off the first heating device for a first predetermined time before a trailing edge of a last sheet-like recording medium in a series of a job passes through the fixing region; and turning off the second heating device for a second predetermined time before the trailing edge of the last sheet-like recording medium passes through the fixing region.

25. A fixing device comprising:

a rotatable fixing member;

heating means for heating the rotatable fixing member; and pressing means for pressing against the rotatable fixing member to form a fixing region through which a sheet-like recording medium passes to fix an unfixed image by heat and pressure; and controlling means for controlling the heating means such that the heating means is turned off for a predetermined time before a trailing edge of a last sheet-like recording medium in a series of a job passes through the fixing region.

26. A fixing device comprising:

a rotatable fixing member;

first heating means for heating the rotatable fixing member;

pressing means for pressing against the rotatable fixing member to form a fixing region through which a sheet-like recording medium passes to fix an unfixed image by heat and pressure;

second heating means for heating the pressing means; and controlling means for controlling the first heating means such that the first controlling means is turned off for a first predetermined time before a trailing edge of a last sheet-like recording medium in a series of a job passes through the fixing region and the second heating means such that the second heating means is turned off for a second predetermined time before the trailing edge of the last sheet-like recording medium passes through the fixing region.

* * * * *